US012558599B2

(12) United States Patent
Colling

(10) Patent No.: US 12,558,599 B2
(45) Date of Patent: Feb. 24, 2026

(54) ATTACHABLE GOAL

(71) Applicant: Skywalker Holdings, LLC, Brigham City, UT (US)

(72) Inventor: Michael J. Colling, Brigham City, UT (US)

(73) Assignee: Skywalker Holdings, LLC, Brigham City, UT (US)

( * ) Notice: Subject to any disclaimer, the term of this patent is extended or adjusted under 35 U.S.C. 154(b) by 0 days.

(21) Appl. No.: 16/421,240

(22) Filed: May 23, 2019

(65) Prior Publication Data

US 2020/0368597 A1 Nov. 26, 2020

(51) Int. Cl.

| | |
|---|---|
| ***A63B 63/00*** | (2006.01) |
| ***A63B 5/11*** | (2006.01) |
| ***A63B 102/14*** | (2015.01) |
| ***A63B 102/22*** | (2015.01) |

(52) U.S. Cl.

CPC ..... *A63B 63/004* (2013.01); *A63B 5/11* (2013.01); *A63B 2102/14* (2015.10); *A63B 2102/22* (2015.10); *A63B 2225/74* (2020.08); *A63B 2243/0025* (2013.01)

(58) Field of Classification Search

CPC ..... A63B 63/004; A63B 2102/14; A63B 2102/12; A63B 5/11; A63B 2207/02; A63B 2243/0025

See application file for complete search history.

(56) References Cited

U.S. PATENT DOCUMENTS 574,235 A * 12/1896 Bennitt ..... A45B 11/00 135/88.04
1,166,496 A * 1/1916 Torrey ..... A63B 63/00 473/173
2,204,432 A * 6/1940 Morgadanes ..... E04H 15/06 135/88.14
2,819,901 A * 1/1958 Mateja ..... A63B 71/022 473/421
2,922,653 A * 1/1960 O'Brien ..... A63B 63/00 403/171
3,256,021 A * 6/1966 Nissen ..... A63B 63/00 182/139
3,502,330 A * 3/1970 Cyrille ..... A63B 5/11 273/395
3,840,228 A * 10/1974 Greaney ..... A63B 63/00 473/446
3,968,809 A * 7/1976 Beavers ..... B60P 3/343 135/88.14
4,100,313 A * 7/1978 Hammer ..... C23C 14/042 427/248.1
4,119,311 A * 10/1978 Jenkins ..... A63B 5/11 273/395

(Continued)

FOREIGN PATENT DOCUMENTS

DE 2846142 A1 * 4/1980 ..... A63B 71/02

*Primary Examiner* — Eugene L Kim
*Assistant Examiner* — Amir A Klayman
(74) *Attorney, Agent, or Firm* — Alliance IP, LLC

(57) ABSTRACT

A goal that is configured to connect to a frame of a trampoline. The goal includes tube clamps, support tubes, pivoting brackets, and multiple bars that support a netting. The tube clamps are rotatable around the poles to which they are attached, and the pivoting brackets can pivot around the connection point with the support tubes.

20 Claims, 7 Drawing Sheets

(56) References Cited

U.S. PATENT DOCUMENTS 4,208,038 A * 6/1980 Reid ..... E04H 17/1413 256/65.02
4,239,235 A * 12/1980 Torres ..... A63B 69/0097 473/434
4,478,420 A * 10/1984 Sowards ..... A63B 69/0097 273/342
4,556,219 A * 12/1985 Tillery ..... A63B 63/00 473/197
4,592,547 A * 6/1986 Thaxton ..... A63B 63/00 273/394
4,838,558 A * 6/1989 Hauff ..... A63B 69/0097 273/395
4,858,922 A * 8/1989 Santavaci ..... A63B 24/0021 473/192
4,926,892 A * 5/1990 Osmonson ..... E04G 21/3233 135/900
5,169,362 A * 12/1992 Schwartz ..... A63B 3/00 482/42
5,178,384 A * 1/1993 Gorman ..... A63B 71/022 135/87
5,205,564 A * 4/1993 Lamberti ..... A63B 63/004 473/421
5,277,430 A * 1/1994 Naccarato ..... A63B 63/00 473/446
5,344,155 A * 9/1994 Huang ..... A63B 43/005 273/348.4
5,571,266 A * 11/1996 Nichols ..... A63B 63/00 273/127 R
5,613,676 A * 3/1997 Connolly ..... A63B 63/004 273/400
5,993,334 A * 11/1999 McNamara ..... A63B 63/00 473/446
6,257,259 B1 * 7/2001 Ardouin ..... B60J 11/08 135/96
6,485,373 B1 * 11/2002 Stephens ..... A63B 63/00 473/162
6,672,980 B1 * 1/2004 Walsh ..... A63B 63/004 473/471
6,733,403 B2 * 5/2004 Courtright ..... A63B 63/083 473/431
6,796,359 B1 * 9/2004 Knutson ..... E04F 10/04 135/88.12
7,244,199 B1 * 7/2007 Romano ..... A63B 71/022 273/127 R
7,331,903 B2 * 2/2008 Nissen ..... A63B 5/11 482/27
7,464,983 B1 * 12/2008 Acosta ..... E04H 15/06 296/159
7,481,740 B2 * 1/2009 Colling ..... A63B 5/11 482/27
8,246,494 B2 * 8/2012 Stephenson ..... A63B 63/004 473/422
8,328,695 B2 * 12/2012 Ronan ..... A63B 5/11 135/156
D718,827 S * 12/2014 Chen ..... D21/797
8,900,074 B1 * 12/2014 Johnson ..... A63B 63/00 473/422
9,486,691 B1 * 11/2016 McGee ..... A63B 71/022
9,550,085 B2 1/2017 Chen
9,797,157 B2 * 10/2017 Lovley, II ..... E04H 15/58
10,258,854 B2 * 4/2019 Chen ..... A63B 63/083
10,456,656 B2 * 10/2019 Deal ..... A63B 71/021
10,758,802 B2 * 9/2020 ViaCava ..... A63B 1/00
10,933,294 B2 * 3/2021 Colling ..... A63B 71/03
11,213,731 B1 * 1/2022 Anderson ..... A63B 63/004
2003/0125121 A1 * 7/2003 Rhee ..... A63B 63/00 473/197
2005/0242508 A1 * 11/2005 Meichner ..... A63B 63/00 273/371
2006/0116226 A1 * 6/2006 Padilla ..... A63B 61/02 473/492
2006/0270525 A1 * 11/2006 Colling ..... A63B 5/11 482/27
2010/0120557 A1 * 5/2010 Klein ..... A63B 69/002 473/434
2010/0317467 A1 * 12/2010 Freynhofer ..... A63B 63/004 473/476
2012/0142499 A1 * 6/2012 Ikegami ..... A63B 5/11 482/27
2012/0322567 A1 * 12/2012 Manieri ..... A63B 71/022 473/197
2013/0143696 A1 * 6/2013 Conforti ..... A63B 63/004 473/478
2015/0024877 A1 * 1/2015 Cowan ..... A63B 63/004 473/478
2016/0361616 A1 * 12/2016 Downing ..... A63B 69/0095
2017/0157485 A1 * 6/2017 Esser ..... A63B 63/00
2019/0160356 A1 * 5/2019 Lalaoua ..... A63B 63/004
2019/0336840 A1 * 11/2019 Hunt ..... A63B 69/0097
2020/0360795 A1 * 11/2020 Sierra Murillo ..... F16M 11/24
2022/0062726 A1 * 3/2022 Kapsalis ..... A63B 71/022

* cited by examiner

ATTACHABLE GOAL

BACKGROUND

The present disclosure relates in general to the field of recreational equipment, and more specifically, to a goal that can be attached to a structure.

Trampolines are popular exercise devices in both recreational and fitness contexts. Conventional trampolines, however, take up a great amount of space. In some contexts, such as, for example, when a trampoline is placed in an individual's backyard, there is little room for other recreational equipment. When space is limited, therefore, it is difficult for a trampoline to coexist with other recreational equipment, such as, a sports goal.

BRIEF DESCRIPTION OF THE DRAWINGS

Like reference numbers and designations in the various drawings indicate like elements.

DETAILED DESCRIPTION

Trampolines are a great source of recreation and exercise for many. As such, trampolines are a popular addition to many residential properties. Trampolines, however, often are large and take up a large amount of space, which can mean that there is little room in a yard, for example, for other recreational structures. It may be desirable to provide a recreational structure, such as, for example, a goal that can be incorporated with a trampoline.

Figure 1:
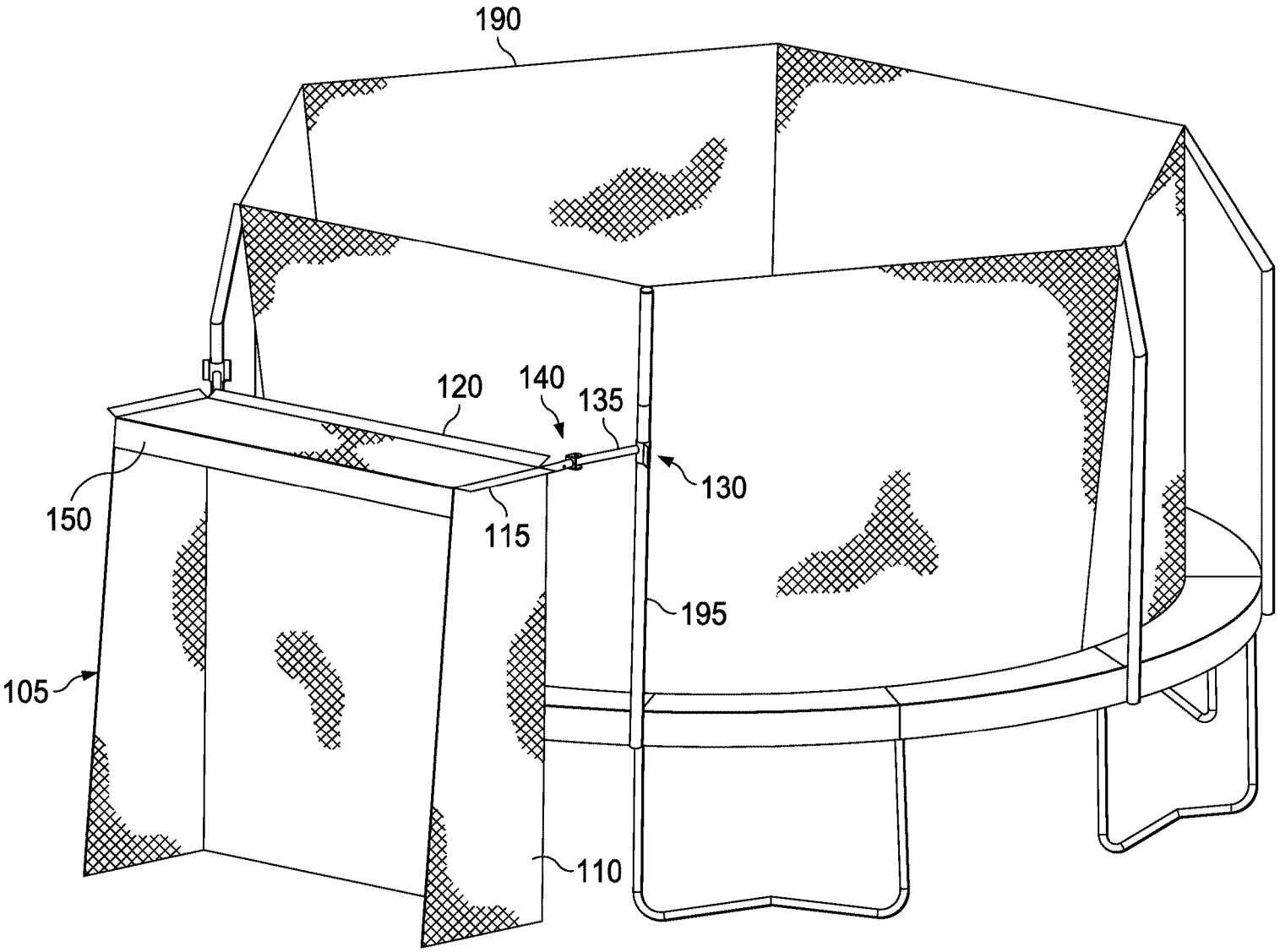
FIG. 1 illustrates an example goal attached to a trampoline in accordance with at least some embodiments.

FIG. 1 illustrates an example implementation of an attachable goal 105. In this particular example, the goal 105 is attached to a trampoline 190. In other cases, a goal can be attached to another structure, such as, for example a fence with posts. Furthermore, goals can incorporate other features discussed herein. In the example of FIG. 1, an example goal 105 can include tube clamps 130 that couple the goal 105 to the trampoline 190. In one case, tube clamps 130 attach to the trampoline 190 via trampoline poles 195. It should be appreciated that in other cases, tube clamps 130 can be attached to other structures similar to trampoline poles. As one example, tube clamps can be attached to the posts of a fence, treehouse, playground equipment, or other heavyweight or anchored structure.

Goal 105 can further include support tubes 135. Support tubes 135 can be coupled to tube clamps 130. In one instance, support tubes are coupled to tube clamps via a permanent coupling, such as, for example, through a permanent weld. It should be appreciated that in other cases, it is possible that support tubes 135 are coupled to tube clamps 130 in methods other than permanent coupling. As one example, support tubes 135 can be coupled to tube clamps 130 via screws or other fasteners.

With continued reference to FIG. 1, goal 105 can further include pivoting brackets 140. Pivoting brackets 140 can be coupled to support tubes 135. If tube clamps 130 are coupled to a first end of support tubes 135, then the pivoting brackets 140 can be coupled to the opposite ends of the corresponding support tubes (e.g., 135).

As shown in the example implementation of FIG. 1, goal 105 can include two pivoting brackets 140 coupled to two separate support tubes (e.g., 135). A back bar 120 can be connected to each of the pivoting brackets 140. In addition, side bars 115 may be coupled to each of the pivoting brackets 140. The side bars (e.g., 115) may be fixedly connected to the back bar 120, and the pivoting brackets (e.g., 140) may connect where a corresponding side bar (e.g., 115) is joined to the back bar (e.g., 120) (e.g., at the corners formed through the connection between a side bar and the back bar). The combination pivoting brackets 140, tube clamps 130, support tubes 135, back bar 120, and side bars 115 comprise the frame for goal 105. This frame can be constructed out of rigid materials, such as, for example, galvanized steel or other materials with suitable strength. To enhance the safety of the goal, and those jumping on trampoline 190, portions of the bars or tubes exposed to users can be wrapped in protective padding. It should be appreciated that, although FIG. 1 illustrates the use of two tube clamps and support tubes, other example goal frames may incorporate multiple pairs of tube clamps and support tubes, among other example alternatives.

Goal 105 can further include netting 110. In the example of FIG. 1, netting 110 is configured to attach to goal 105 via back bar 120 and side bars 115. In one implementation, netting 110 includes sleeves (not shown.) In particular, one sleeve is configured to receive back bar 120 and two other sleeves are configured to receive one of the side bars 115 each. Netting 110 can be sized for any particular need. Furthermore, there can be different sized nettings available for different purposes. For example, it is possible, as discussed later, to increase or decrease the size of goal 105. As such, difference sizes of nets can be used with goal 105. In one implementation, one goal can be sized smaller for a sport, such as, field hockey. In another implementation, the goal can be sized for a sport with a need for a larger goal, such as, for example, soccer. In some implementations, different sized back and side bars may be used with correspondingly sized nets. Accordingly, nets may be permanently or fixedly connected to back and side bar structures, and this net module may be removably attached to the pivoting brackets (e.g., 140) of the support tubes (e.g., 135). For instance, a smaller field hockey or lacrosse net module may be swapped out for a larger soccer net module by detaching the smaller net module from the pivoting brackets, adjusting the pivot angle of the support tubes (i.e., the accommodate the width of the larger net module) and replacing the detached smaller net module with the larger net module, among other example use cases and scenarios.

Netting 110 can be constructed out of a flexible fabric or netted material which allows the goal to be used for a variety of different sports and/or activities. Netting 110 can also include one or more portions that are more rigid to provide for greater support. As an example, the sleeves that encompass the side bars 115 and back bar 120 can comprises a more rigid plastic. As another example, netting 115 can include front support section 150. This is a portion of netting 115 that is rigid, allowing for greater support of the frame of goal 105. In the example implementation of FIG. 1, front support section can include rigid plastic. In another example implementation, front support section 150 can include a wooden, plastic, or metal dowel or rod. In yet another implementation, the frame of goal 105 can include a front bar (not shown) that is coupled between the two side bars 115. The front bar can be similar to the back bar 120. It should be appreciated, that the use of a front bar may limit the movement and adjustability of the goal.

Since supporting structures can vary in size and make, such as, for example, the sizing of the space between trampoline poles can differ between different makes and models of trampolines. If a fence post is used, the sizing between posts can differ from a trampoline. As such, allowing movement of the goal structure during setup allows the goal 105 to be used on a variety of different supporting structures. The use of tube clamps 130 and pivoting brackets 140 allow the maneuverability of goal 105.

Figure 2A:
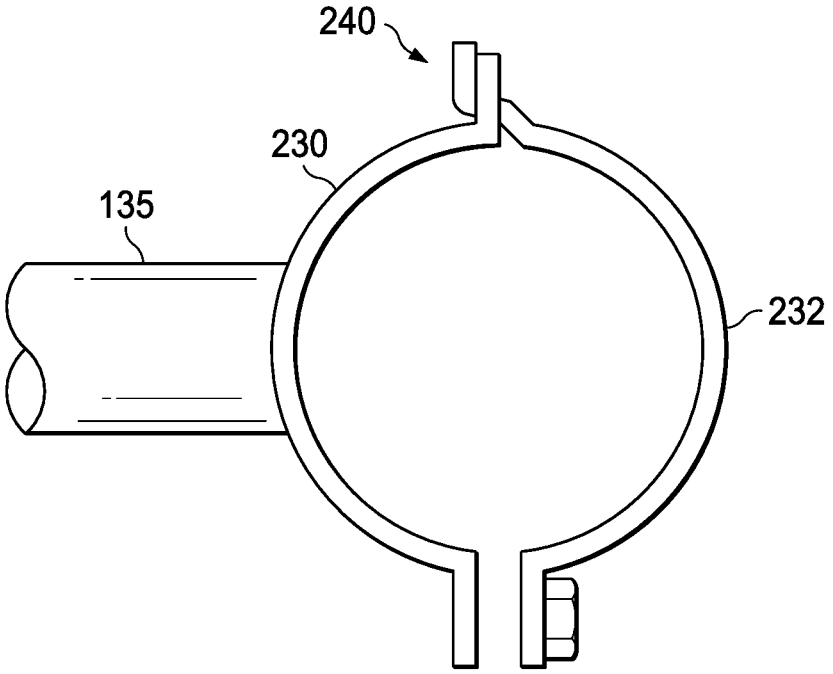
FIGS. 2A-2B illustrate details of an example tube clamp of a goal in accordance with at least some embodiments.
Figure 2B:
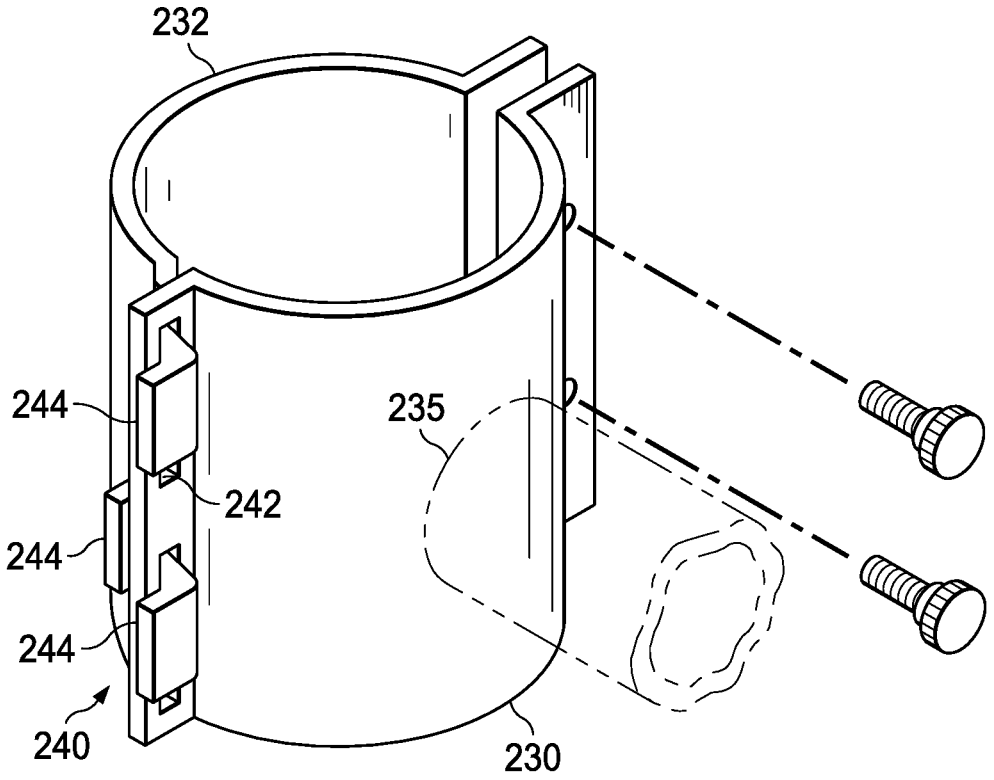

FIGS. 2A-2B illustrate an example implementation of tube clamp 130. As shown with respect to FIG. 1, tube clamps 130 couple goal 105 to a trampoline or similar structure. FIG. 2A illustrates a first view of an example tube clamp. The tube clamp in FIG. 2A can be the same as or similar to tube clamp 130 of FIG. 1. Tube clamp 130 can include two separate parts, a front portion 230 and a rear portion 232. The two portions can be coupled together at hinge 240. As shown in the example of FIG. 2A, support tube 135 is coupled to the tube clamp 130. The front portion 230 and rear portion can be fixed together using a fastener. In one implementation, the two portions are fixed together using a nut and bolt combination. As an example, a wing nut and bolt can be used. It should be appreciated that other types of fasteners may be used to fasten rear portion 232 and front portion 230 together.

Turning to FIG. 2B, a second view of an example tube clamp is shown. The example of FIG. 2B illustrates how the hinge 240 of tube clamp 130 operates. In the implementation of FIG. 2B, one portion of the tube clamp includes one or more hinge holes 242, while the other portion of the tube clamp includes one or more hinge protrusions 244. In the implementation shown in FIG. 2B, there is one more protrusion 244 than holes 242. One protrusion 244 will go in a corresponding hole 242. The extra protrusion, which is in between the two other protrusions in this example, remains free and the portion of the tube clamp with the holes 242 is bracketed by the protrusions 244. In this particular implementation, the front portion 230 includes the holes 242 and the rear portion includes the protrusions 244. It should be appreciated, however, that the front portion 230 can include the protrusions 244, while the rear portion 232 can include the holes 242. It should also be appreciated that hinges other than the type shown in the examples of FIGS. 2*a* and 2*b* can be used. As one example, a hinge similar to those used for a door can be used.

FIG. 2B also illustrates where the support tube 135 is coupled to the tube clamp 130. In this example, the tube connection 235 is a hard weld as discussed above. It should also be appreciated that the tube clamps illustrated in the figures disclosed herein show the tube clamps being coupled to a pole that is completely vertical, the tube clamps can be altered if need to be attached to a different type of pole, such as, for example, the poles of an "A" frame swing set.

Figure 3A:
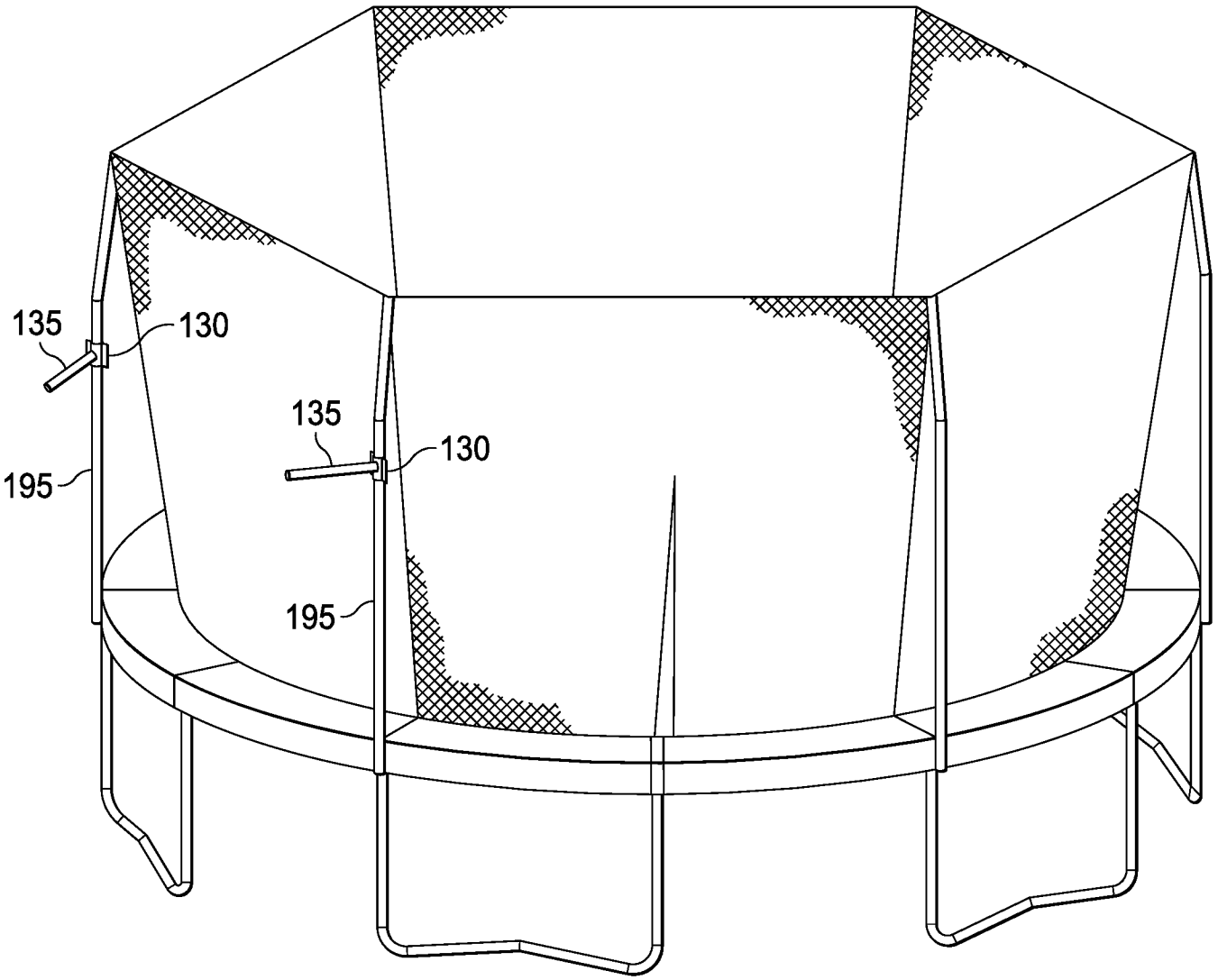
FIGS. 3A-3D illustrate details of an example of an attachment of a tube clamp onto a pole in accordance with at least some embodiments.
Figure 3B:
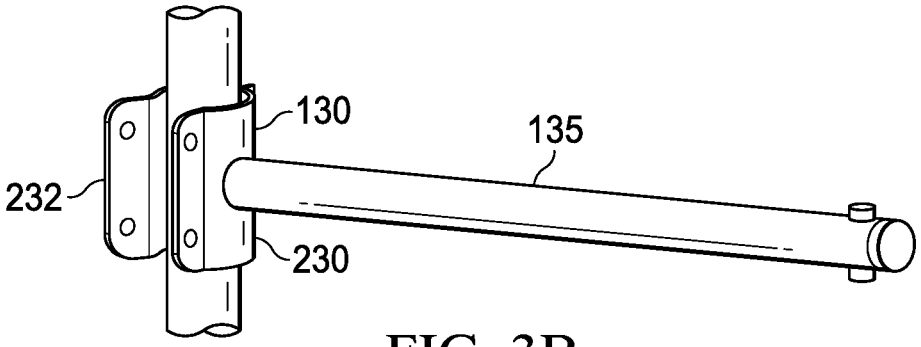

FIGS. 3A-D illustrate an example implementation of how tube clamps 130, which are coupled to support tubes 135, are coupled to trampoline posts 195. FIG. 3A illustrates tube clamps 130 coupled to trampoline posts 195. FIG. 3B illustrates the initial placing of a tube clamp 130 onto the post 195. As seen in the example of FIG. 3B, the rear portion 232 of clamp 130 goes on one side of the post 195, while the front portion 230 of clamp 130 is placed on the other side of the post 195. Thus, post 195 is positioned between the front portion 230 and rear portion 232 of clamp 130.

Figure 3C:
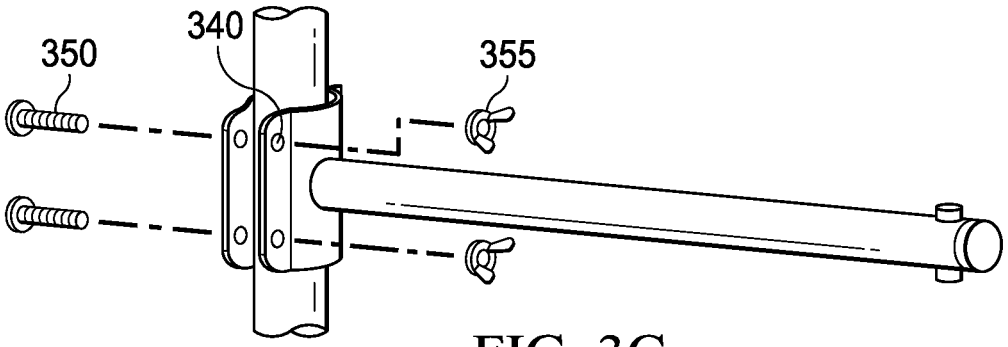
Figure 3D:
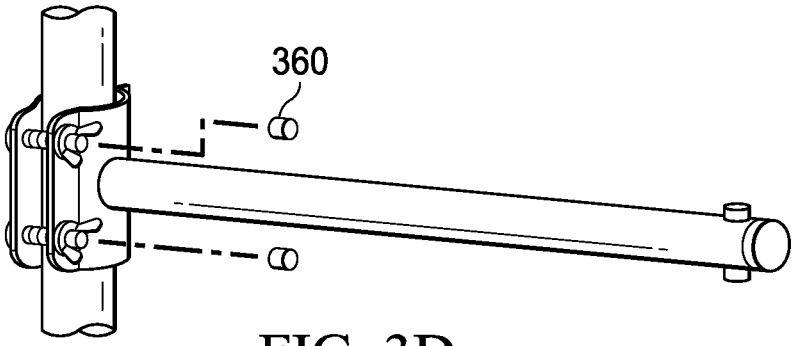

Next, FIG. 3C illustrates how the two separate portions of clamp 130 are fastened together using a fastener. In this example implementation, a bolt 350 with wing nuts 355 are used. As an example, the bolt 350 passes through holes 340 on the rear portion 232 and front portion 230 of clamp 130. Wing nut 355 is then attached to the bolt 350. Finally, FIG. 3D illustrates the use of a cover 360. Cover 360 can be used to cover the protruding portions of the nut 355 and bolt 350. The use of the cover can contribute to the safety of the design.

Tube clamps 130, once attached to the posts 195, can be rotated around posts 195, while not moving vertically along the post. This allows the angles of the support tubes 135 to be adjusted to correspond to the length of the back bar 120 and allow the back bar 120 to be properly coupled to the pivoting brackets 140. In addition, the hinged design of tube clamps 130 allows the clamps to be used on a variety of different sizes of posts 195. In some examples, different sized clamps 130 may be available depending on the size of posts 195 being used to support goal 105. In some instances, only a single one of the tube clamps may be configured to rotate around the pole to which it is coupled. In other instances, tube clamps can comprise a lock once the goal is situated to prevent future movement of the clamps around the poles.

Figure 4A:
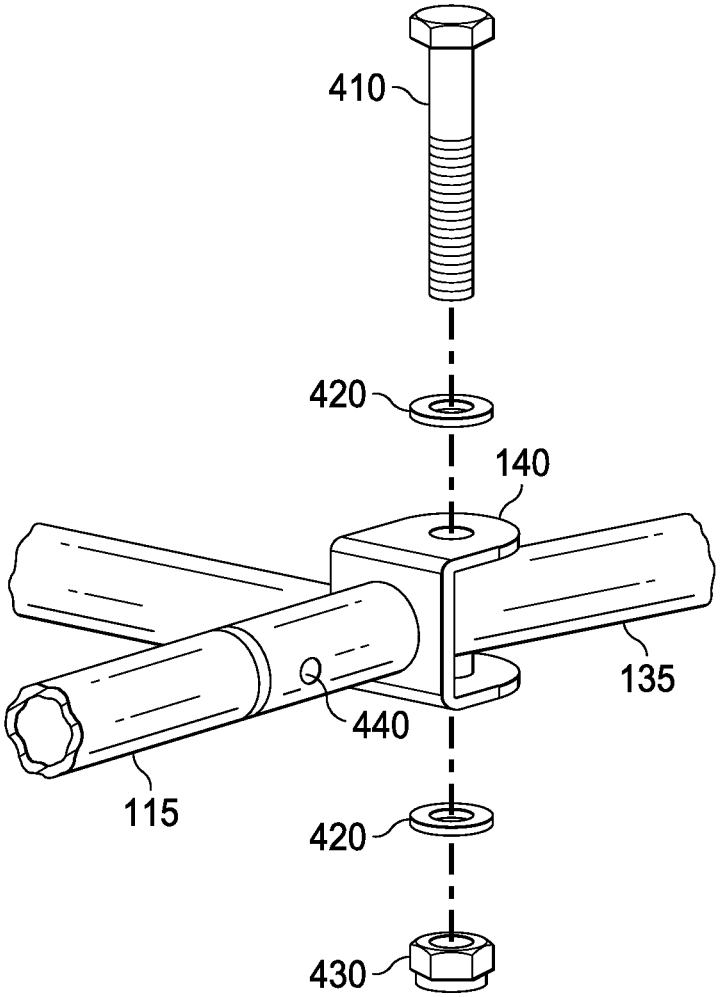
FIGS. 4A-4B illustrate details of an example pivoting bracket of a goal in accordance with at least some embodiments.
Figure 4B:
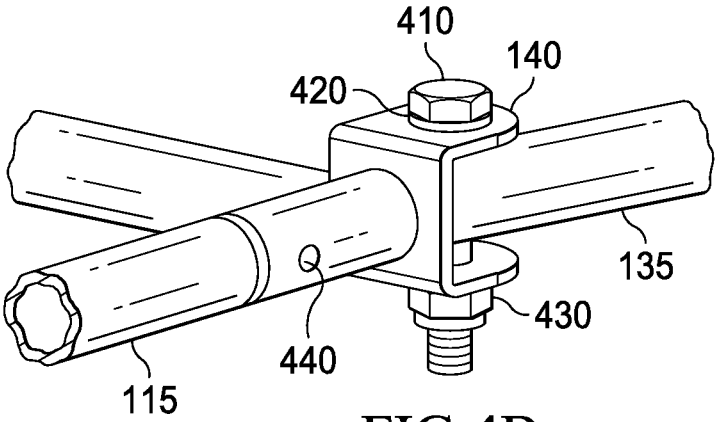

Turning to FIGS. 4A and 4B, an example of a pivoting bracket 140 is illustrated. FIG. 4A illustrates an implementation of the pivoting bracket as it is coupled to support tube 135. In the example of FIG. 4A, pivoting bracket is coupled to support tube 135 via a bolt 410 and nut 430. In addition, a washer 420 can be placed between bolt 410 and pivoting bracket 140, and another washer can be placed between nut 430 and pivoting bracket 140. FIG. 4B illustrates the pivoting bracket 140 coupled to support tube 135. The coupling of pivoting bracket 140 to support tube 135 allows the pivoting bracket to rotate in the direction of the arrows illustrated in FIG. 4B. In other instances, pivoting brackets can comprise a lock once the goal is situated to prevent future movement of the pivoting brackets when the goal is in use.

In addition, FIGS. 4A and 4B illustrate the connection between pivoting bracket 140 and side bar 115. Side bar 115 can be coupled to pivoting bracket 140 via connection point 440. In one implementation, side bar 115 is configured to fit inside the pivoting bracket 140. In one example, a screw is used to couple the side bar 115 to pivoting bracket 140 at connection point 440. In another example, spring-loaded push pin elements can be used to couple the side bar 115 to pivoting bracket 140 at connection point 440.

Figure 5:
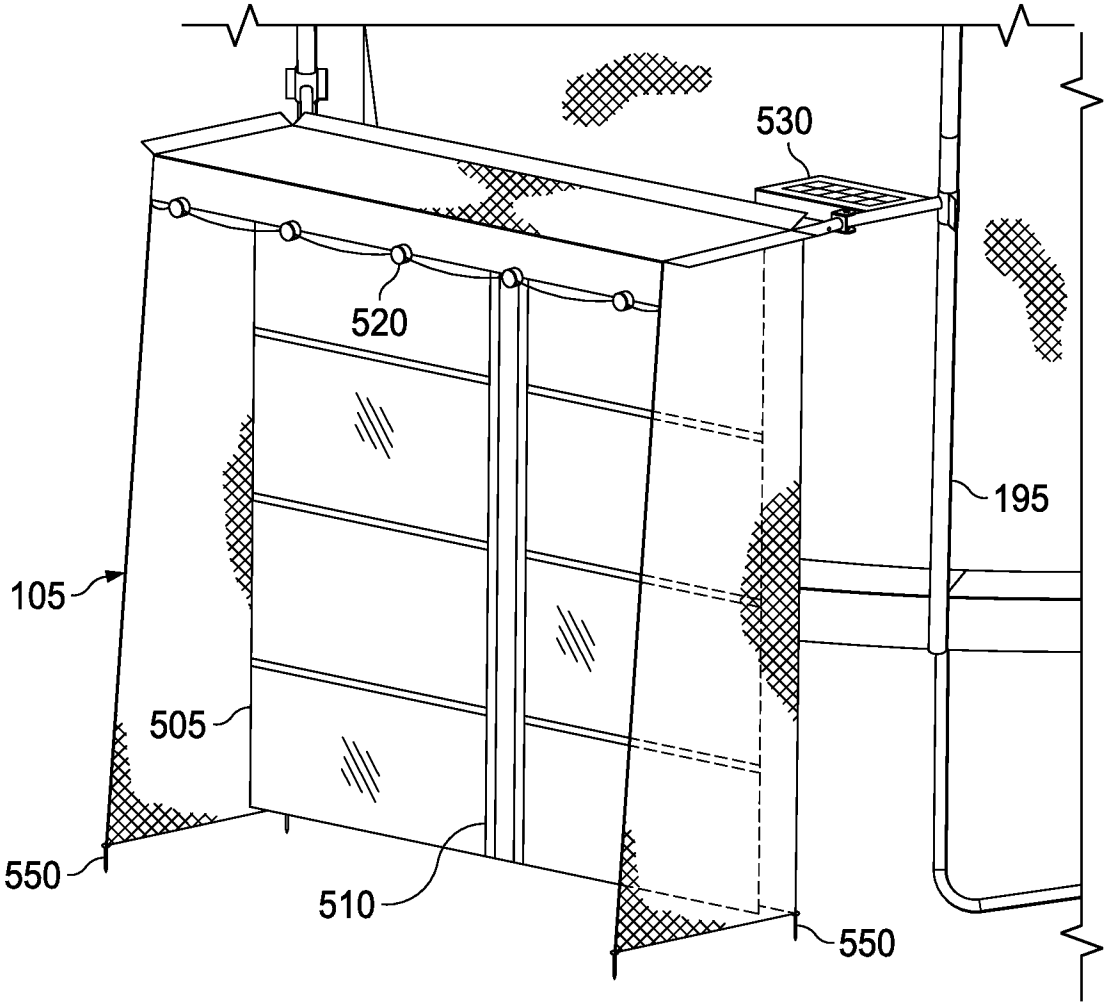
FIG. 5 illustrates an example goal attached to a trampoline in accordance with at least some embodiments.

FIG. 5 shows some examples of additional implementations of goal 105. In some implementations, goal 105 can comprise a banner 505. Banner 505 can be used for activities with the goal. For example, a banner specific to sports can be used to practice that sport. The banner 505 may be removably attached to a portion of the goal 105 (e.g., the top of the net, the back bar, the front support section, the side bars, etc.). For instance, a hook and look type fasteners or ties may be incorporated at one or more edges or corners of the banner 505 to facilitate attachment of the banner to the remaining goal 105. Such banners 505 may be removed and reattached, as the user desires, to allow multiple different targets and target types to be incorporated in the goal and customize or enhance the form and appearance of the goal.

In some cases, a banner may be double-sided, allowing two different target designs to be available on the front and back sides of the banner, thereby enabling a user to detach and flip around the banner 505 to allow an alternative target or sport to be practiced.

In one implementation, there can be targets on the banner, which correspond to a particular sport. The targets may be printed on the banner 505, be implemented as cutouts on the banner 505, among other examples. As examples, the banner 505 may be configured to represent targets at which a field hockey or soccer player may aim. In another example, the banner can be used to practice baseball or softball pitching, among other example embodiments. Indeed, it should be appreciated that a wide variety of possible banners may be designed and implemented together with goal 105. In some examples, there may be more than one banners attached to the goal 105. This can be especially useful in situations where an object needs to slow down after traveling at a high rate of speed. The object, if it hits multiple banners, will slow down more before hitting the back net, which may cause damage if not slowed down enough. In some implementations, banner 505 can comprise photoreactive elements 510. The photoreactive elements 510 can be used to stand out more to the eye or allow use in low light conditions, thus creating a better target, etc. The photoreactive elements can comprise any element that appears to illuminate the design of the banner 505. It should also be appreciated that photoreactive elements 510 can be on goal 105 in places other than banner 505.

As shown in the example of FIG. 5, goal 105 can include lights 520, such as, for example, LED lights. As an example, lights 520 can be used to light up goal 105 when it is dark outside. In the same or other examples, lights 520 can used to illuminate banner 505, similar to photoreactive elements 510. Furthermore, goal 105 can have a power source 530 for lights 520. In one example, power source 530 can comprise battery compartment. In another example, power source 530 can comprise a solar panel if lights 530 are solar powered. Lights (e.g., 520) and/or power sources (e.g., 530) may be connected to or mounted on structures of the goal's net or frame.

With continued reference to FIG. 5, goal 105 can further include stakes 550 to hold netting 110 in place. Stakes 550 can be connected to the bottom sections of the netting 110 and pushed into the ground to fix the bottom edges and/or corners of the netting at or near the group and keep netting 110 still and secure when goal 105 is in use, among other example structure and features.

Figure 6:
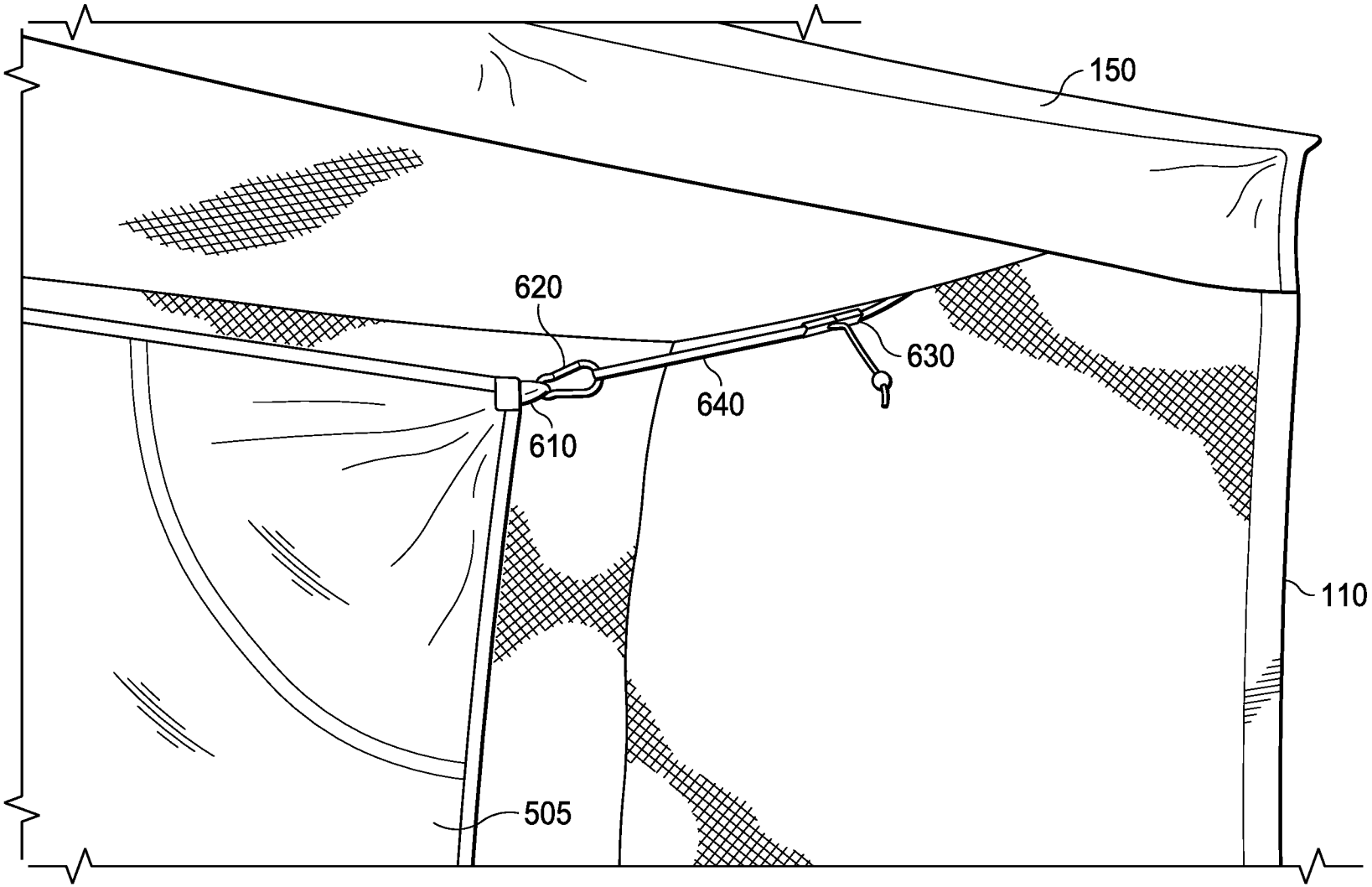
FIG. 6 illustrates an example banner coupled to a goal in accordance with at least some embodiments.

FIG. 6 illustrates an example of how banner 505 is coupled to goal 105. In one implementation, banner 505 includes one or more straps 610. In one implementation, there are two straps 610. In such example implementation, there is a strap 610 in each of the upper corners of banner 505. For simplicity, FIG. 6 illustrates the upper right corner of banner 505. It should be appreciated that the upper left corner of banner 505 can be similarly situated. Strap 610 can be coupled to a clip 620. As an example, clip 620 can be a ring or carabiner in some implementations. Netting 110 can comprise a cord attachment 630, from which a tension cord 640 can be coupled with clip 620. In one implementation, cord attachment 630 can be a spring-loaded toggle cord lock. Furthermore, the tension cord 640 can be made of an elastomeric material. The combination of the elastic tension cord 640 and a toggle cord attachment 630 allows different sizes of banners to be placed in goal 105, because the length of the cord 640 can be adjusted or stretched to connect to the goal frame structure. Furthermore, the use of a carabiner as clip 620 allows for a quick and easy change of banner 505, among other example features and embodiments.

It should be appreciated that the particular examples illustrated and discussed above are provided merely to illustrate more general principles of this disclosure. Indeed, it should be appreciated that other features, changes, and alternative embodiments may be implemented without departing from the more general features proposed herein. Reference throughout this specification to "one implementation" or "an implementation" means that a particular feature, structure, or characteristic described in connection with the implementation is included in at least one implementation of the present disclosure. Thus, the appearances of the phrases "in one implementation," "in an implementation," "in one example," "in some examples," "in some instances," etc. in various places throughout this specification are not necessarily all referring to the same implementation. Furthermore, the particular features, structures, or characteristics may be combined in any suitable manner in one or more implementations.

The following examples pertain to embodiments in accordance with this disclosure. In accordance with some implementations, a goal including: a first tube clamp to couple to a first pole; a second tube clamp to couple to a second pole; a first support tube coupled to the first tube clamp and a first pivoting bracket; a second support tube coupled to the second tube clamp and a second pivoting bracket; a back bar coupled to the first pivoting bracket and the second pivoting bracket; and a netting. The first tube clamp is rotatable about the first pole, the second tube clamp is rotatable around the second pole, the first pivoting bracket can pivot around the connection point between the first pivoting bracket and the first support tube, and the second pivoting bracket can pivot around the connection point between the second pivoting bracket and the second support tube.

In some instances, an apparatus may further include a first side bar coupled to the first pivoting bracket and a second side bar coupled to the second pivoting bracket. The netting can be coupled to the first side bar, the second side bar, and the back bar. The apparatus can further include a banner. The banner can include a first strap coupled to the netting and a second strap coupled to the netting. Furthermore, a first clip can be coupled to the first strap and a second clip can be coupled to the second strap. The first clip can be coupled to the netting via a first cord attached to a first cord attachment on the netting and the second clip can be coupled to the netting via a second cord attached to a second cord attachment on the netting.

Furthermore, in some instances, the apparatus can include one more lights. The lights can be LED lights in some implementations. In some instances, the lights are solar powered lights and the apparatus further includes a solar panel. In some instances, the banner includes photoreactive elements.

In some implementations, a method or process of assembling a goal can include attaching a first tube clamp to a first pole attaching a second tube clamp to a second pole; wherein the first tube clamp is coupled to a first support tube and the second tube clamp is coupled to a second support tube; coupling the first support tube to a first pivoting bracket and a first side bar; coupling the second support tube to a second pivoting bracket and a second side bar; coupling a back bar to the first pivoting bracket and the second pivoting; and coupling a netting to the back bar, the first side bar, and the second side bar.

In some implementations, the first bracket clamp and the second bracket clamp are rotatable around the first pole or the second pole. Furthermore, the first pivoting bracket can pivot around the connection point between the first pivoting bracket and the first support tube, and the second pivoting bracket can pivot around the connection point between the second pivoting bracket and the second support tube. In addition, in some implementations, the method includes coupling a banner to the netting.

In accordance with some implementations, a goal can include a netting, and a moveable goal frame that includes at least two rotatable connection points connected to a trampoline; a distinct support a distinct support tube coupled to each of the at least two rotatable connection points; a distinct bracket that can pivot coupled to each of the distinct support tubes; and a back bar coupled to each of the distinct brackets that can pivot; and a distinct side bar coupled to each of the distinct brackets that can pivot.

Furthermore, the goal can include a banner. In some instances, the banner can include one or more photoreactive elements. In some examples, the goal can further include at least one light. In some instances, each of the distinct support tubes is coupled to its respective rotatable connection point by welding Thus, particular embodiments of the subject matter have been described. Other embodiments are within the scope of the following claims. In some cases, the features, components, and actions recited in the claims can be arranged or performed in a different manner and still achieve desirable results. In addition, the processes depicted in the accompanying figures do not necessarily require the particular order shown, or sequential order, to achieve desirable results.

A detailed description has been given with reference to specific exemplary embodiments. It will, however, be evident that various modifications and changes may be made thereto without departing from the broader spirit and scope of the invention as set forth in the appended claims. The specification and drawings are, accordingly, to be regarded in an illustrative sense rather than a restrictive sense. Furthermore, the foregoing use of embodiment and other exemplarily language does not necessarily refer to the same embodiment or the same example, but may refer to different and distinct embodiments, as well as potentially the same embodiment.

The invention claimed is:

1. An apparatus comprising:

a goal comprising:

a first tube clamp to couple to a vertically oriented first pole external to and separate from the goal;

a second tube clamp to couple to a vertically oriented second pole external to and separate from the goal, wherein the vertically oriented first pole is positioned a first distance from the vertically oriented second pole;

a first support tube, wherein a first end of the first support tube is coupled to the first tube clamp and a second end of the first support tube is coupled to a first pivoting bracket;

a second support tube, wherein a first end of the second support tube is coupled to the second tube clamp and a second end of the second support tube is coupled to a second pivoting bracket;

a back bar, wherein a first end of the back bar is coupled to the first pivoting bracket and a second end of the back bar is coupled to the second pivoting bracket; and a netting coupled to the back bar, wherein the netting and back bar are to be positioned in front of and away from the first and second pole based on lengths of the first and second support tubes;

wherein the first pivoting bracket is configured to facilitate the first support tube to pivot about a first vertical axis at the second end of the first support tube, the second pivoting bracket is configured to facilitate the second support tube to pivot about a second vertical axis at the second end of the second support tube, and the first pivoting bracket and the second pivoting bracket allow the back bar to be alternatively coupled to a vertically oriented third pole via the first tube clamp and a vertically oriented fourth pole via the second tube clamp, wherein the vertically oriented third pole is positioned a different second distance from the vertically oriented fourth pole.

2. The apparatus of claim 1, further comprising:

a first side bar coupled to the first pivoting bracket; and a second side bar coupled to the second pivoting bracket.

3. The apparatus of claim 2, wherein the netting is coupled to the first side bar, the second side bar, and the back bar, a first side wall of the goal is formed from the netting below the first side bar, a second side wall of the goal is formed from the netting below the second side bar, and a back wall of the goal is formed from the netting below the back bar.

4. The apparatus of claim 1, further comprising a banner.

5. The apparatus of claim 4, wherein the banner comprises a first strap and a second strap; and wherein the first strap and the second strap are coupled to the netting.

6. The apparatus of claim 5, wherein the banner further comprises a first clip attached to the first strap, and second clip attached to the second strap;

wherein the netting comprises a first cord attachment and a second cord attachment; and wherein the first cord attachment is coupled to the first clip via a first cord; and the second cord attachment is coupled to the second clip via a second cord.

7. The apparatus of claim 4, wherein the banner comprises one or more photoreactive elements.

8. The apparatus of claim 1, further comprising one or more lights and a power source for the one or more lights.

9. The apparatus of claim 8, wherein the one or more lights are LED lights.

10. The apparatus of claim 8, wherein one or more or more lights are solar powered lights and the power source comprises at least one solar panel.

11. The apparatus of claim 1, wherein the first pole comprises a first pole of a trampoline and the second pole comprises a second pole of the trampoline.

12. The apparatus of claim 1, wherein the netting is constructed from one of a flexible fabric or a netted material.

13. A method for assembling a goal, the method comprising:

attaching a first tube clamp of the goal to a vertically oriented first pole external to and separate from the goal, wherein the first tube clamp comprises a first portion, a second portion, and a fastener;

attaching a second tube clamp of the goal to another vertically oriented, second pole external to and separate from the goal, wherein the second tube clamp comprises a first portion, a second portion, and a fastener, wherein the first tube clamp is coupled to a first end of a first support tube and the second tube clamp is coupled to a first end of a second support tube;

coupling a second end of the first support tube to a first pivoting bracket and a first side bar, wherein the first pivoting bracket is configured to facilitate the first support tube pivoting about a first vertical axis at the second end of the first support tube;

coupling a second end of the second support tube to a second pivoting bracket and a second side bar, wherein the second pivoting bracket is configured to facilitate the second support tube pivoting about a second vertical axis at the second end of the second support tube;

coupling a back bar to the first pivoting bracket and the second pivoting bracket, wherein the second end of the first support tube and the back bar correspond to an upper left interior corner of the goal and the second of the second support tube and the back bar correspond to an upper right interior corner of the goal, wherein coupling the back bar to the first pivoting bracket comprises pivoting the first support tube in the first pivoting bracket based on a distance between the first pole and the second pole and to position the back bar away from the first and second poles; and coupling a netting to the back bar, the first side bar, and the second side bar.

14. The method of claim 13, wherein the first support tube is coupled to the first pivoting bracket via a pin inserted through the first support tube and the first pivoting bracket at the first vertical axis.

15. The method of claim 13, further comprising attaching a banner to the netting.

16. A trampoline system comprising:

a trampoline jumping surface;

a safety enclosure to provide an upright border corresponding to at least a portion of a perimeter of the jumping surface;

a frame comprising a first plurality of support poles to elevate the trampoline jumping surface above a ground surface and a second plurality of vertically oriented support poles to connect to and support the safety enclosure; and a goal coupled to at least two of the second plurality of support poles to position the goal outside of and away from the perimeter of the jumping surface, wherein the goal comprises:

a netting;

a moveable goal frame configured to attach to the at least two of the second plurality of support poles, wherein the netting is coupled to the moveable goal frame and the moveable goal frame comprises:

a first pivot bracket;

a second pivot bracket;

a back bar, wherein a first end of the back bar is fixedly coupled to the first pivot bracket, and a second end of the back bar is fixedly coupled to the second pivot bracket;

a first side bar fixedly coupled to the first pivot bracket;

a second side bar fixedly coupled to the second pivot bracket;

a first horizontal support, wherein the first horizontal support comprises a first end to be coupled to the first pivot bracket to pivot about a first vertical axis, and further comprises a second end comprising a first coupler to removably couple to a first one of the at least two of the second plurality of support poles; and a second horizontal support, wherein the second horizontal support comprises a first end to be coupled to the second pivot bracket to pivot about a second vertical axis, and further comprises a second end comprising a second coupler to removably couple to a second one of the at least two of the second plurality of support poles;

wherein the netting is coupled to the back bar, the first side bar, and the second side bar, and wherein the moveable goal frame is configured to be removed from the at least two of the second plurality of support poles and alternatively coupled to another pair of poles separate from the trampoline system.

17. The trampoline system of claim 16, further comprising a banner.

18. The trampoline system of claim 17, wherein the banner comprises one or more photoreactive elements.

19. The trampoline system of claim 16, further comprising at least one light.

20. The trampoline system of claim 16, wherein each of the distinct support tubes is coupled to its respective rotatable connection point by welding.

* * * * *